US012000395B2

(12) United States Patent
Matsunaga et al.

(10) Patent No.: US 12,000,395 B2
(45) Date of Patent: Jun. 4, 2024

(54) SCROLL COMPRESSOR AND REFRIGERATION CYCLE DEVICE

(71) Applicant: Hitachi-Johnson Controls Air Conditioning, Inc., Tokyo (JP)

(72) Inventors: Kazuyuki Matsunaga, Tokyo (JP); Ryota Iijima, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 7 days.

(21) Appl. No.: 17/901,944

(22) Filed: Sep. 2, 2022

(65) Prior Publication Data

US 2023/0077032 A1 Mar. 9, 2023

(30) Foreign Application Priority Data

Sep. 3, 2021 (JP) ..... 2021-143695

(51) Int. Cl.
*F04C 18/02* (2006.01)
*F04C 29/02* (2006.01)

(52) U.S. Cl.
CPC ..... *F04C 18/0261* (2013.01); *F04C 18/0215* (2013.01); *F04C 18/0253* (2013.01); *F04C 29/023* (2013.01); *F04C 2240/603* (2013.01)

(58) Field of Classification Search
CPC ..... F04C 18/0261; F04C 18/0215; F04C 18/0253; F04C 29/023; F04C 2240/603
See application file for complete search history.

(56) References Cited

U.S. PATENT DOCUMENTS 9,127,669 B2 * 9/2015 Tsuka ..... F04C 18/0261
10,480,509 B2 * 11/2019 Murakami ..... F04C 18/0215

FOREIGN PATENT DOCUMENTS

JP 2016-017484 A 2/2016

OTHER PUBLICATIONS

Foreign Patent and Machine translation for KR-10-2021-0010808; Inventor: Takashi; Title: Scroll Compressor; Published Jan. 28, 2021. (Year: 2021).*

* cited by examiner

*Primary Examiner* — Mary Davis
(74) *Attorney, Agent, or Firm* — MATTINGLY & MALUR, PC

(57) ABSTRACT

In a scroll compressor, at an end plate surface of a fixed scroll, an annular back pressure groove connected to a back pressure chamber is provided, and an arc-shaped first groove and an arc-shaped second groove are provided inside the back pressure groove in a radial direction. A distance between the second groove and the back pressure groove is shorter than a distance between the first groove and the back pressure groove. A revolving scroll is provided with a first hole and a second hole for guiding lubricant oil from an oil supply path to the end plate surface side of the fixed scroll. At least part of a movement locus of an opening of the first hole is included in the first groove. At least part of a movement locus of an opening of the second hole is included in the second groove. The first groove and the second groove at least partially overlap with each other in the radial direction.

18 Claims, 6 Drawing Sheets

SCROLL COMPRESSOR AND REFRIGERATION CYCLE DEVICE

CROSS-REFERENCE TO RELATED APPLICATION

This application claims priority from Japanese Patent Application No. 2021-143695, filed with the Japan Patent Office on Sep. 3, 2021, the entire content of which is hereby incorporated by reference.

BACKGROUND

1. Technical Field

One aspect of the present disclosure relates to a scroll compressor and the like.

2. Related Art

For a scroll compressor, e.g., a technique described in JP-A-2016-17484 has been known as the technique of holding a thrust load (force in an axial direction) from one of a fixed scroll or a revolving scroll to the other one of the fixed scroll or the revolving scroll within a proper range. That is, JP-A-2016-17484 describes that an oil groove extending in a circumferential direction of a sliding surface of the fixed scroll such that lubricant oil flows in the oil groove is provided.

SUMMARY

A scroll compressor includes: a hermetic container; an electric motor having a stator and a rotor and housed in the hermetic container; a shaft having an oil supply path in which lubricant oil flows and rotating integrally with the rotor; a fixed scroll having a spiral fixed wrap; a revolving scroll having a spiral revolving wrap and provided such that a compression chamber is formed between the fixed wrap and the revolving wrap; and a frame having an insertion hole for the shaft and supporting the fixed scroll. A back pressure chamber is provided between the revolving scroll and the frame. At an end plate surface of the fixed scroll, an annular back pressure groove connected to the back pressure chamber is provided, and an arc-shaped first groove and an arc-shaped second groove are provided inside the back pressure groove in a radial direction. A distance between the second groove and the back pressure groove is shorter than a distance between the first groove and the back pressure groove. The revolving scroll is provided with a first hole and a second hole for guiding the lubricant oil from the oil supply path to an end plate surface side of the fixed scroll. At least part of a movement locus of an opening of the first hole is included in the first groove, and at least part of a movement locus of an opening of the second hole is included in the second groove. The first groove and the second groove at least partially overlap with each other in the radial direction.

DETAILED DESCRIPTION

Figure 1:
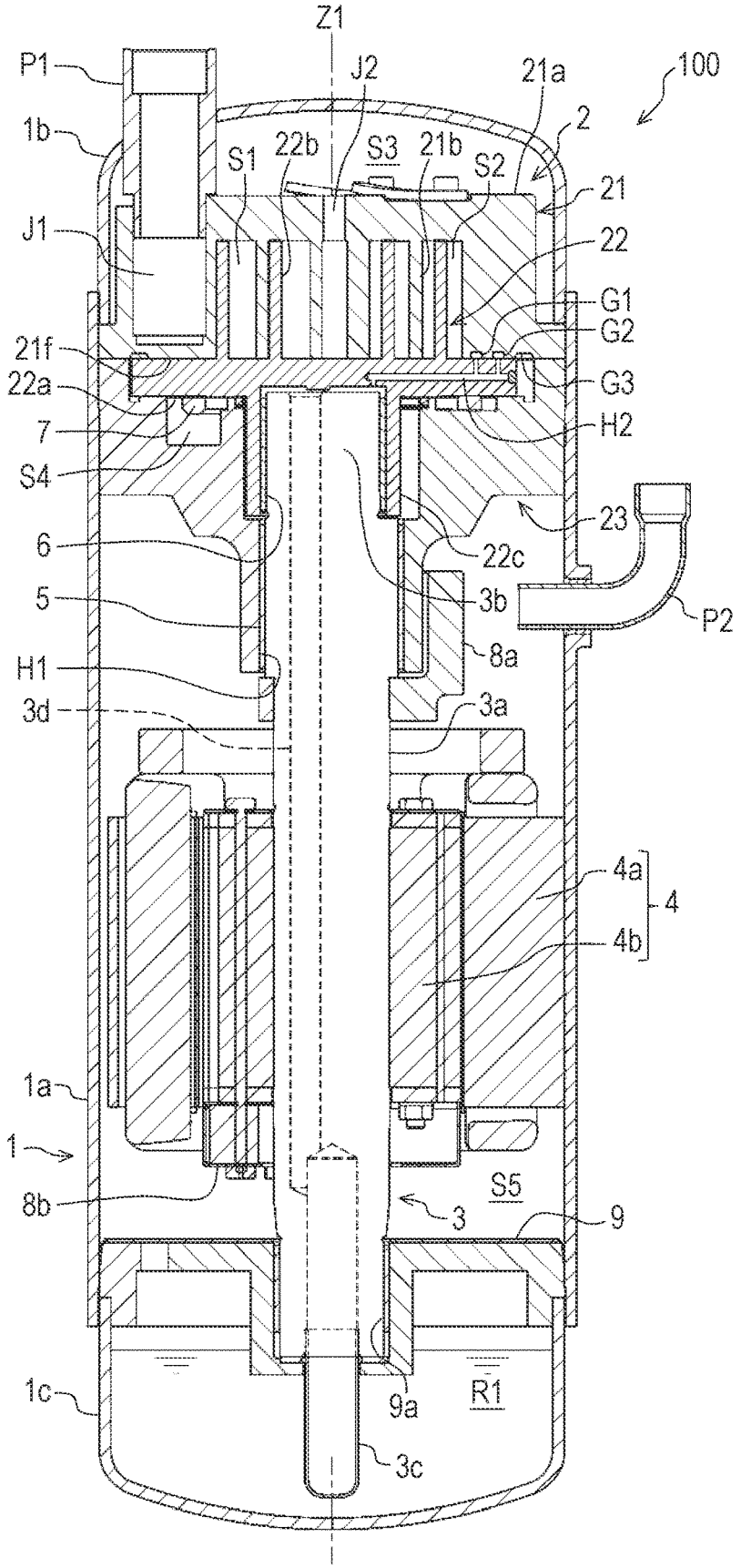
FIG. 1 is a longitudinal sectional view of a scroll compressor according to a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

For example, for reducing a sliding loss, which greatly influences a year-round energy consumption efficiency, between the fixed scroll and the revolving scroll under a low load, the force of pushing up the revolving scroll to a fixed scroll side tends to be set to small force. In the technique described in JP-A-2016-17484, in a case where the scroll compressor is, for example, operated with a low compression ratio, high-pressure lubricant oil is injected into the oil groove of the fixed scroll. Thus, there is a probability that such lubricant oil excessively increases the force of pushing down the revolving scroll. As a result, the revolving scroll may swing, leading to efficiency degradation and reliability degradation.

For this reason, one object of the present disclosure is to provide a scroll compressor and the like with a high efficiency and a high reliability.

A scroll compressor according to one aspect of the present disclosure includes: a hermetic container; an electric motor having a stator and a rotor and housed in the hermetic container; a shaft having an oil supply path in which lubricant oil flows and rotating integrally with the rotor; a fixed scroll having a spiral fixed wrap; a revolving scroll having a spiral revolving wrap and provided such that a compression chamber is formed between the fixed wrap and the revolving wrap; and a frame having an insertion hole for the shaft and supporting the fixed scroll. A back pressure chamber is provided between the revolving scroll and the frame. At an end plate surface of the fixed scroll, an annular back pressure groove connected to the back pressure chamber is provided, and an arc-shaped first groove and an arc-shaped second groove are provided inside the back pressure groove in a radial direction. A distance between the second groove and the back pressure groove is shorter than a distance between the first groove and the back pressure groove. The revolving scroll is provided with a first hole and a second hole for guiding the lubricant oil from the oil supply path to an end plate surface side of the fixed scroll. At least part of a movement locus of an opening of the first hole is included in the first groove, and at least part of a movement locus of an opening of the second hole is included in the second groove. The first groove and the second groove at least partially overlap with each other in the radial direction.

Note that other points will be described in embodiments.

According to the above-described aspect of the present disclosure, the scroll compressor and the like can be provided with a high efficiency and a high reliability.

First Embodiment

<Configuration of Scroll Compressor>

FIG. 1 is a longitudinal sectional view of a scroll compressor 100 according to a first embodiment.

The scroll compressor 100 is equipment configured to compress gaseous refrigerant. As shown in FIG. 1, the scroll compressor 100 includes a hermetic container 1, a compression mechanism portion 2, a crankshaft 3 (a shaft), an electric motor 4, a main bearing 5, and a revolving bearing 6. In addition to the above-described configuration, the scroll compressor 100 further includes an Oldham's ring 7, balance weights 8*a*, 8*b*, and a sub-frame 9.

The hermetic container 1 is a shell-shaped container housing the compression mechanism portion 2, the crankshaft 3, the electric motor 4, and the like, and is substantially hermetically sealed. Lubricant oil for lubricating the compression mechanism portion 2 and each bearing is sealed in the hermetic container 1. The lubricant oil is stored as an oil sump R1 on a bottom portion of the hermetic container 1. The hermetic container 1 includes a cylindrical tube chamber 1*a*, a lid chamber 1*b* closing an upper side of the tube chamber 1*a*, and a bottom chamber 1*c* closing a lower side of the tube chamber 1*a*.

A suction pipe P1 is inserted into and fixed to the lid chamber 1*b* of the hermetic container 1. The suction pipe P1 is a pipe for guiding refrigerant to a suction port J1 of the compression mechanism portion 2. Moreover, a discharge pipe P2 is inserted into and fixed to the tube chamber 1*a* of the hermetic container 1. The discharge pipe P2 is a pipe for guiding refrigerant compressed in the compression mechanism portion 2 to the outside of the scroll compressor 100.

The compression mechanism portion 2 is a mechanism configured to compress gaseous refrigerant as the crankshaft 3 rotates. The compression mechanism portion 2 includes a fixed scroll 21, a revolving scroll 22, and a frame 23. The compression mechanism portion 2 is arranged in an upper space in the hermetic container 1.

The fixed scroll 21 is a member configured such that the fixed scroll 21 and the revolving scroll 22 together form compression chambers S1. The fixed scroll 21 is placed on an upper side of the frame 23, and is fastened to the frame 23 with a bolt (not shown). As shown in FIG. 1, the fixed scroll 21 includes a base plate 21*a* and a fixed wrap 21*b*.

The base plate 21*a* is a thick member in a circular shape as viewed in plane. Note that for ensuring a region S2 (a bottom portion of the fixed wrap 21*b*) where a revolving wrap 22*b* revolves relative to the fixed wrap 21*b*, a portion of the fixed wrap 21*b* between inner and outer lines thereof is recessed upwardly in a predetermined manner as viewed from below. A suction port J1 to which refrigerant is guided through the suction pipe P1 is provided at the base plate 21*a*.

The fixed wrap 21*b* is in a spiral shape (also see FIG. 4), and in the above-described region S2, extends downwardly from the base plate 21*a*. Note that a lower surface (a lower surface of an outer portion of the region S2 in a radial direction) of the base plate 21*a* and a tooth tip of the fixed wrap 21*b* are substantially flush with each other. Moreover, the lower surface of the base plate 21*a* will be also referred to as an end plate surface 21*f* (also see FIG. 4) of the fixed scroll 21. The end plate surface 21*f* is provided with an annular back pressure groove G3 (also see FIG. 4), an arc-shaped first groove G1 (also see FIG. 4), and an arc-shaped second groove G2 (also see FIG. 4). Details of these grooves will be described later.

The revolving scroll 22 is a member configured to move (revolve) to form the compression chambers S1 between the revolving scroll 22 and the fixed scroll 21. The revolving scroll 22 is provided between the fixed scroll 21 and the frame 23. The revolving scroll 22 includes a discoid end plate 22*a*, the spiral revolving wrap 22*b* (also see FIG. 3) standing on the end plate 22*a*, and a tubular boss portion 22*c* fitted onto an eccentric portion 3*b* of the crankshaft 3. As shown in FIG. 1, the revolving wrap 22*b* extends upwardly from the end plate 22*a*. On the other hand, the boss portion 22*c* extends downwardly from the end plate 22*a*.

The revolving wrap 22*b* is a member configured such that the revolving wrap 22*b* and the fixed wrap 21*b* together form the compression chambers S1. That is, the spiral fixed wrap 21*b* and the spiral revolving wrap 22*b* engage with each other to form the multiple compression chambers S1 between the fixed wrap 21*b* and the revolving wrap 22*b*. Note that the compression chamber S1 is a space for compressing gaseous refrigerant. The compression chambers S1 are each formed on outer and inner line sides of the revolving wrap 22*b*. A discharge port J2 is provided in the vicinity of the center of the base plate 21*a* of the fixed scroll 21. The discharge port J2 is an opening for guiding refrigerant compressed in the compression chamber S1 to a space S3 above the compression mechanism portion 2.

The frame 23 is a member supporting the fixed scroll 21. The frame 23 is in a substantially rotational symmetrical shape. The frame 23 is, by, e.g., welding, fixed to an inner peripheral wall of the tube chamber 1*a* of the hermetic container 1. The frame 23 is provided with an insertion hole H1 into which the crankshaft 3 is to be inserted.

A back pressure chamber S4 is provided between the revolving scroll 22 and the frame 23. The back pressure chamber S4 is a space on a back side (a side on which the boss portion 22*c* extends from the end plate 22*a*) of the revolving scroll 22. That is, a space between the revolving scroll 22 and the frame 23 forms the back pressure chamber S4.

Note that when gaseous refrigerant is compressed as the volume of the compression chamber S1 decreases, the downward force of separating the revolving scroll 22 from the fixed scroll 21 is generated. If the revolving scroll 22 is separated from the fixed scroll 21, the tooth tip of the fixed wrap 21*b* separates from the revolving scroll 22, and a tooth tip of the revolving wrap 22*b* separates from the fixed scroll 21. Accordingly, refrigerant leaks from the compression chamber S1. This leads to degradation of the efficiency of the scroll compressor 100.

For this reason, for reducing separation of the revolving scroll 22 from the fixed scroll 21, a space (a reference numeral is not shown) with a pressure substantially equal to a discharge pressure and the above-described back pressure chamber S4 are provided in the vicinity of the center of the revolving scroll 22 on the back side thereof (inside the boss portion 22*c* in the radial direction). Note that the pressure of the back pressure chamber S4 is normally a predetermined intermediate pressure between the suction and discharge pressures of the scroll compressor 100. With this configuration, the upward force of moderately pressing the revolving scroll 22 against the fixed scroll 21 is generated.

Note that the term "back pressure" included in the back pressure chamber S4 does not specifically limit the level of the pressure of the back pressure chamber S4. The pressure of the back pressure chamber S4 is often a value between the suction pressure and the discharge pressure. Note that in some cases, the pressure of the back pressure chamber S4 is temporarily substantially equal to the discharge pressure.

The crankshaft 3 (the shaft) shown in FIG. 1 is a shaft to be rotated integrally with a rotor 4*b* of the electric motor 4, and extends in an up-down direction. As shown in FIG. 1, the crankshaft 3 includes a main shaft portion 3*a*, the eccentric portion 3*b* extending upwardly from the main shaft portion 3*a*, and an oil supply piece 3*c* placed at a lower end of the main shaft portion 3*a*.

The main shaft portion 3*a* is coaxially fixed to the rotor 4*b* of the electric motor 4. The main shaft portion 3*a* rotates integrally with the rotor 4*b*. The eccentric portion 3*b* is a shaft to be rotated eccentrically with respect to the main shaft portion 3*a*. As described above, the eccentric portion 3*b* is fitted in the boss portion 22*c* of the revolving scroll 22. The revolving scroll 22 revolves by eccentric rotation of the eccentric portion 3*b*.

The oil supply piece 3*c* is a portion for sucking up the lubricant oil from the oil sump R1 of the hermetic container 1, and is placed at the lower end of the main shaft portion 3*a*. Note that, e.g., a displacement pump or a centrifugal pump may be provided at the oil supply piece 3*c*. The crankshaft 3 has an oil supply path 3*d* in which the lubricant oil flows. The lubricant oil stored as the oil sump R1 in the hermetic container 1 flows up in the oil supply path 3*d*. Note that the oil supply path 3*d* is branched in a predetermined manner such that the lubricant oil is also supplied to the main bearing 5, the revolving bearing 6, and the like as described later.

The electric motor 4 is a drive source configured to rotate the crankshaft 3, and is placed between the frame 23 and the sub-frame 9. As shown in FIG. 1, the electric motor 4 includes a stator 4*a* and the rotor 4*b*. The stator 4*a* is fixed to the inner peripheral wall of the tube chamber 1*a*. The rotor 4*b* is rotatably arranged inside the stator 4*a* in the radial direction. The crankshaft 3 is, by, e.g., press-fitting, fixed to the rotor 4*b* coaxially with the center axis Z1 of the rotor 4*b*.

The main bearing 5 rotatably pivotally supports an upper portion of the main shaft portion 3*a* on the frame 23. The main bearing 5 is provided on a peripheral wall surface of a hole (a reference numeral is not shown) of the frame 23.

The revolving bearing 6 rotatably pivotally supports the eccentric portion 3*b* on the boss portion 22*c* of the revolving scroll 22. The revolving bearing 6 is provided on an inner peripheral wall of the boss portion 22*c*.

The Oldham's ring 7 is a ring-shaped member revolving the revolving scroll 22 without rotating the revolving scroll 22 in response to eccentric rotation of the eccentric portion 3*b*. The Oldham's ring 7 is attached to a groove (not shown) provided at a lower surface of the revolving scroll 22 and a groove (not shown) provided at the frame 23.

The balance weights 8*a*, 8*b* are members for reducing vibration of the scroll compressor 100. In an example of FIG. 1, one balance weight 8*a* is placed above the rotor 4*b* on the main shaft portion 3*a*. The other balance weight 8*b* is placed on a lower surface of the rotor 4*b*.

The sub-frame 9 is a member rotatably pivotally supporting a lower portion of the main shaft portion 3*a*. As shown in FIG. 1, the sub-frame 9 is fixed to the hermetic container 1 with arranged below the electric motor 4. The sub-frame 9 is provided with a hole (a reference numeral is not shown) into which the crankshaft 3 is to be inserted. A sub-bearing 9*a* is provided on a peripheral wall surface of the hole of the sub-frame 9.

When the crankshaft 3 is rotated by drive of the electric motor 4, the revolving scroll 22 revolves accordingly. Then, the sequentially-formed compression chamber S1 is decreased in size, and gaseous refrigerant is compressed. The compressed refrigerant is discharged to the space S3 above the compression mechanism portion 2 through the discharge port J2 of the fixed scroll 21. The refrigerant discharged to the space S3 as described above is guided to a motor chamber S5 through a flow path (not shown) between the compression mechanism portion 2 and the hermetic container 1, and is further discharged to the outside through the discharge pipe P2.

The lubricant oil stored as the oil sump R1 on the bottom of the hermetic container 1 flows up in the oil supply path 3*d* of the crankshaft 3, and lubricates the sub-bearing 9*a*, the main bearing 5, the revolving bearing 6, and the like. The lubricant oil having reached an opening (a reference numeral is not shown) of an upper end of the oil supply path 3*d* is guided to a connection hole H2 (also see FIG. 2) of the revolving scroll 22 as described later. Next, detailed configurations of the fixed scroll 21 and the revolving scroll 22 will be described while the flow of lubricant oil is described.

Figure 2:
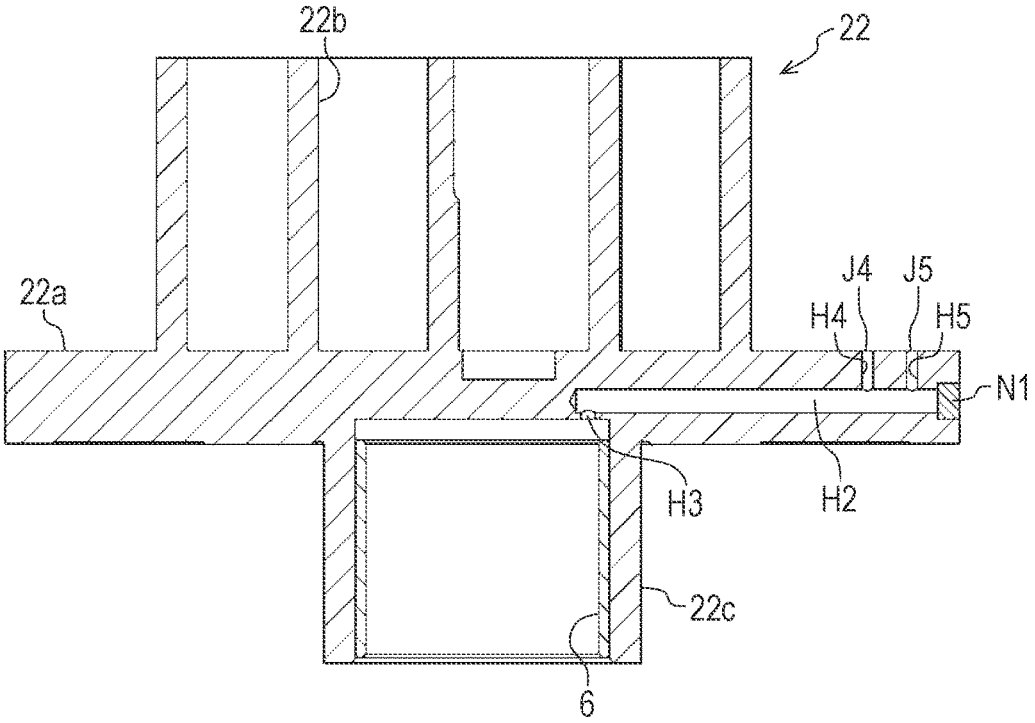
FIG. 2 is a longitudinal sectional view of a revolving scroll included in the scroll compressor according to the first embodiment.

FIG. 2 is a longitudinal sectional view of the revolving scroll 22 included in the scroll compressor.

As shown in FIG. 2, one connection hole H2 is provided in a lateral direction (a direction parallel with upper and lower surfaces of the end plate 22*a*) at the end plate 22*a* of the revolving scroll 22. In an example of FIG. 2, the connection hole H2 is provided in the radial direction of the discoid end plate 22*a*. Note that the connection hole H2 may be provided in a direction different from the radial direction in the lateral direction.

The connection hole H2 is a flow path for guiding the high-pressure lubricant oil flowing in the oil supply path 3*d* (see FIG. 1) of the crankshaft 3 to a fixed scroll 21 (see FIG. 1) side. The connection hole H2 is, for example, formed in such a manner that cutting is performed inwardly in the radial direction for a peripheral wall surface of the end plate 22*a* in a predetermined manner. A seal N1 shown in FIG. 2 is a member configured to seal an outer peripheral end portion of the connection hole H2. As shown in FIG. 2, an upstream side (the inside in the radial direction) of the connection hole H2 is connected to a space inside the boss portion 22*c* in the radial direction through a relatively-short up-down flow path H3. Moreover, a downstream side (the outside in the radial direction) of the connection hole H2 is connected not only to a first hole H4 but also to a second hole H5.

The first hole H4 is a flow path for guiding the high-pressure lubricant oil to the arc-shaped first groove G1 (see FIG. 4), and is provided in the up-down direction. The second hole H5 is a flow path for guiding the high-pressure lubricant oil to the arc-shaped second groove G2 (see FIG. 4), and is provided in the up-down direction. Part of the lubricant oil flowing out of the oil supply path 3*d* (see FIG. 1) of the crankshaft 3 is guided to the first groove G1 (see FIG. 4) sequentially through the flow path H3, the connection hole H2, and the first hole H4 shown in FIG. 2, and is also guided to the second groove G2 (see FIG. 4) through the second hole H5. That is, the connection hole H2 is connected to the oil supply path 3*d*, and is connected to both of the first hole H4 and the second hole H5. Note that the second hole H5 is provided outside the first hole H4 in the radial direction.

Figure 3:
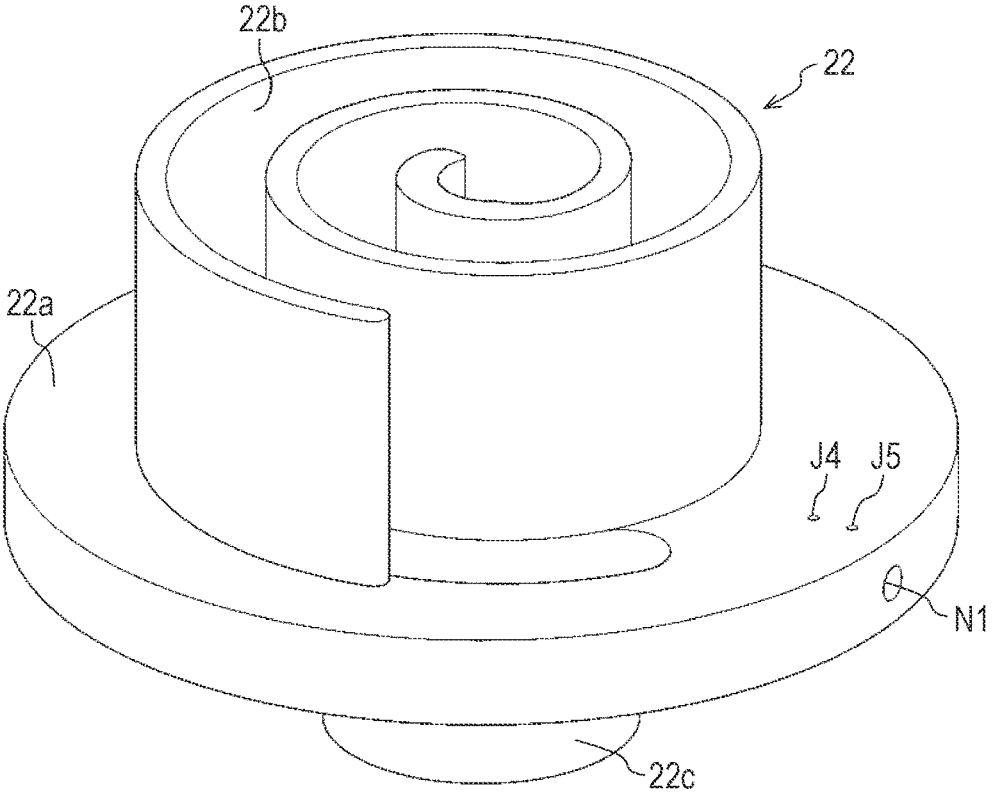
FIG. 3 is a perspective view of the revolving scroll included in the scroll compressor according to the first embodiment.

FIG. 3 is a perspective view of the revolving scroll 22 included in the scroll compressor.

As described above, the revolving scroll 22 includes the discoid end plate 22*a*, the spiral revolving wrap 22*b*, and the tubular boss portion 22*c*. At a location of the peripheral wall surface of the end plate 22*a* of the revolving scroll 22 corresponding to the first hole H4 (see FIG. 2) and the second hole H5 (see FIG. 2), the seal N1 closing the outer peripheral end portion of the connection hole H2 is provided. At the upper surface of the end plate 22*a*, an opening J4 of the first hole H4 is provided, and an opening J5 of the second hole H5 is provided. As shown in FIG. 3, the opening J5 of the second hole H5 is provided outside the opening J4 of the first hole H4 in the radial direction. The opening J4 of the first hole H4 and the opening J5 of the second hole H5 move in a predetermined manner as the revolving scroll 22 revolves.

As described above, the force of pressing the revolving scroll 22 against the fixed scroll 21 acts by the back pressure of the back pressure chamber S4 (see FIG. 1). However, if the force of pressing the revolving scroll 22 against the fixed scroll 21 becomes too great under, e.g., an operation condition with a high compression ratio, there is a probability that a friction loss increase and/or seizure are caused between sliding surfaces of the fixed scroll 21 and the revolving scroll 22. For this reason, the annular back pressure groove G3 (see FIG. 4) and the arc-shaped first groove G1 (see FIG. 4) as described next are provided outside the fixed wrap 21*b* at the end plate surface 21*f* (see FIG. 4) of the fixed scroll 21. Although details will be described later, the arc-shaped second groove G2 (see FIG. 4) is provided at the end plate surface 21*f* (see FIG. 4) of the fixed scroll 21, preparing for a case where swing of the revolving scroll 22 is caused.

Figure 4:
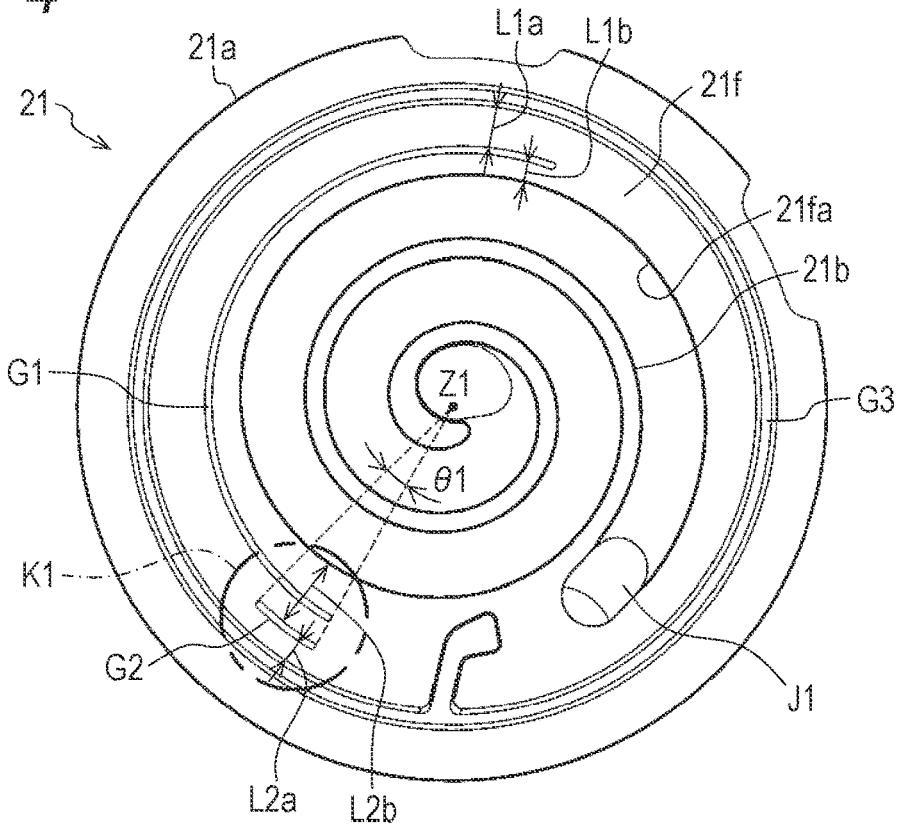
FIG. 4 is a bottom view of a fixed scroll included in the scroll compressor according to the first embodiment.

FIG. 4 is a bottom view of the fixed scroll 21 included in the scroll compressor. As described above, the fixed scroll 21 has the base plate 21*a* and the spiral fixed wrap 21*b* provided on the base plate 21*a*. As shown in FIG. 4, the annular back pressure groove G3 is provided in the vicinity of the peripheral edge of the end plate surface 21*f* of the fixed scroll 21. The back pressure groove G3 is a groove connected to the back pressure chamber S4 (see FIG. 1) between the revolving scroll 22 (see FIG. 1) and the frame 23 (see FIG. 1). In an example of FIG. 4, the back pressure groove G3 is formed as a circular groove about the vicinity of the center of the circular end plate surface 21*f* (the center of the circle).

During revolving of the revolving scroll 22 (see FIG. 1), the lubricant oil with a pressure substantially equal to the pressure of the back pressure chamber S4 is guided to the back pressure groove G3. More specifically, the lubricant oil enters a clearance between the annular back pressure groove G3 and the upper surface of the end plate 22*a* (see FIG. 1) of the revolving scroll 22 from the back pressure chamber S4. This can suppress the force of pushing up the fixed scroll 21 by the revolving scroll 22 from excessively increasing. Further, the lubricant oil in the back pressure groove G3 serves as a seal. This can reduce the inflow of compressed refrigerant from the space S3 (see FIG. 1).

As shown in FIG. 4, the first groove G1 and the second groove G2 are provided at the end plate surface 21*f* of the fixed scroll 21. The first groove G1 and the second groove G2 are provided inside the annular back pressure groove G3 in the radial direction, and for example, is formed in a predetermined arc shape about the vicinity of the center of the back pressure groove G3 (the center of the arc). On the other hand, the first hole H4 (see FIG. 2) and the second hole H5 (see FIG. 2) are provided at the revolving scroll 22 (see FIG. 2) as described above. The first hole H4 and the second hole H5 guide the lubricant oil from the oil supply path 3*d* (see FIG. 1) of the crankshaft 3 (the shaft) to an end plate surface 21*f* side of the fixed scroll 21.

The first groove G1 shown in FIG. 4 is a groove intermittently connected to the first hole H4 (see FIG. 2) of the revolving scroll 22 as the revolving scroll 22 (see FIG. 1) moves (revolves). The first groove G1 is provided to include a region (also referred to as an offset load region) where the end plate 22*a* (see FIG. 1) of the revolving scroll 22 most strongly contacts the end plate surface 21*f* of the fixed scroll 21 in a case where the force (the resultant force of centrifugal force and a gas load) of tilting the revolving scroll 22 with respect to the end plate surface 21*f* of the fixed scroll 21 acts on the revolving scroll 22, for example. Specifically, the first groove G1 is formed in the shape of an arc with a center angle of equal to or greater than 90° and equal to or less than 180° about the vicinity of the center of the circular end plate surface 21*f* (the center of the circle). Note that the above-described offset load region may be arranged in the vicinity of the center of the first groove G1 in a circumferential direction.

As the revolving scroll 22 (see FIG. 1) moves, the first groove G1 is intermittently connected to the first hole H4 (see FIG. 2), and the lubricant oil with a high pressure substantially equal to the discharge pressure is guided to the first groove G1. Accordingly, the high-pressure lubricant oil enters the region (the vicinity of the first groove G1) where the end plate 22*a* (see FIG. 1) of the revolving scroll 22 tends to strongly contact the end plate surface 21*f* (see FIG. 1) of the fixed scroll 21. As a result, the force of separating the revolving scroll 22 from the fixed scroll 21 acts on the first groove G1. This can suppress a thrust load (pressing force) from one of the revolving scroll 22 or the fixed scroll 21 to the other one of the revolving scroll 22 or the fixed scroll 21 from excessively increasing.

The second groove G2 shown in FIG. 4 is a groove intermittently connected to the second hole H5 (see FIG. 2) of the revolving scroll 22 as the revolving scroll 22 (see FIG. 1) moves (revolves). As described above, the first groove G1 and the back pressure groove G3 are provided at the end plate surface 21*f* of the fixed scroll 21 so that the thrust load from one of the fixed scroll 21 or the revolving scroll 22 to the other one of the fixed scroll 21 or the revolving scroll 22 can fall within a proper range. However, it is sometimes difficult to reduce swing of the revolving scroll 22 under any operation condition.

For this reason, in the first embodiment, when the revolving scroll 22 swings, the high-pressure lubricant oil in the second groove G2 flows into the back pressure chamber S4 (see FIG. 1) through the annular back pressure groove G3. Since the lubricant oil with a high pressure substantially equal to the discharge pressure flows into the back pressure chamber S4 as described above, the pressure of the back pressure chamber S4 temporarily increases. As a result, the force of pushing up the revolving scroll 22 against the fixed scroll 21 increases, and therefore, swing of the revolving scroll 22 can be reduced.

In the example of FIG. 4, the arc-shaped second groove G2 about the vicinity of the center of the base plate 21*a* of the fixed scroll 21 (the center of the arc) is provided between the first groove G1 and the back pressure groove G3. That is, a distance L2*a* between the second groove G2 and the back pressure groove G3 is shorter than a distance L1*a* between the first groove G1 and the back pressure groove G3. As described above, the first embodiment is mainly characterized in that the second groove G2 separated from the first groove G1 is provided outside the first groove G1 in the radial direction. Note that the "distance" between the second groove G2 and the back pressure groove G3 indicates the length of a line segment connecting the second groove G2 and the back pressure groove G3 in the shortest distance (the same also applies to other distances L1*a* and the like).

As described above, the distance between the second groove G2 and the back pressure groove G3 is relatively short. Thus, in a case where the revolving scroll 22 swings and tilts, almost all of the high-pressure lubricant oil in the second groove G2 flows into the back pressure groove G3. As described above, the pressure of the lubricant oil in the second groove G2 is substantially equal to the discharge pressure, and is higher than the pressure of the lubricant oil in the back pressure groove G3. The high-pressure lubricant oil flows into the back pressure groove G3 as described above, and accordingly, the pressure of the back pressure chamber S4 (see FIG. 1) temporarily increases. Thus, swing of the revolving scroll 22 can be reduced.

A distance L1*b* between an inner edge 21*fa* of the end plate surface 21*f* of the fixed scroll 21 and the first groove G1 is shorter than a distance L2*b* between the inner edge 21*fa* of the end plate surface 21*f* and the second groove G2. As described above, the distance between the inner edge 21*fa* of the end plate surface 21*f* and the first groove G1 is relatively short. Thus, the high-pressure lubricant oil in the first groove G1 is moderately supplied to the compression chamber S1 (see FIG. 1) through a tiny clearance between the end plate surface 21*f* of the fixed scroll 21 and the end plate 22*a* (see FIG. 1) of the revolving scroll 22. Accordingly, the fixed wrap 21*b* (see FIG. 1), the revolving wrap 22*b* (see FIG. 1), and the like are lubricated, and therefore, abrasion and seizure thereof can be reduced. Moreover, the high-pressure lubricant oil in the arc-shaped first groove G1 also serves as a seal between the fixed scroll 21 and the revolving scroll 22. Thus, the efficiency of the scroll compressor 100 can be enhanced. Note that in the middle of compression of refrigerant, the pressure of the compression chamber S1 is lower than the discharge pressure (the pressure of the lubricant oil in the first groove G1), and is much lower than the pressure of the back pressure chamber S4.

Next, the length of the second groove G2 in the circumferential direction will be described. As shown in FIG. 4, the length of the arc-shaped second groove G2 in the circumferential direction is preferably shorter than the length of the arc-shaped first groove G1 in the circumferential direction. According to this configuration, an excessive inflow of the high-pressure lubricant oil into the second groove G2 is suppressed. As a result, the force of separating the revolving scroll 22 from the fixed scroll 21 can be moderately suppressed. Moreover, the length of the arc-shaped second groove G2 in the circumferential direction is more preferably shorter than the half of the length of the arc-shaped first groove G1 in the circumferential direction. According to this configuration, the amount of high-pressure lubricant oil in the second groove G2 can be moderately suppressed.

The center angle θ1 (the center angle of an imaginary fan shape about the center of the base plate 21*a*) of the arc-shaped second groove G2 is preferably equal to or greater than 10° and equal to or less than 30°. According to this configuration, the volume of an arc-shaped clearance between the second groove G2 and the end plate 22*a* (see FIG. 1) of the revolving scroll 22 can be moderately suppressed. This can suppress the force of separating the revolving scroll 22 from the fixed scroll 21 from excessively increasing.

The first groove G1 and the second groove G2 at least partially overlap with each other in the radial direction. In the example of FIG. 4, the substantially entirety of the second groove G2 overlaps with the first groove G1 in the radial direction. A reason why such a configuration is advantageous will be described using a partially-enlarged view of FIG. 5.

Figure 5:
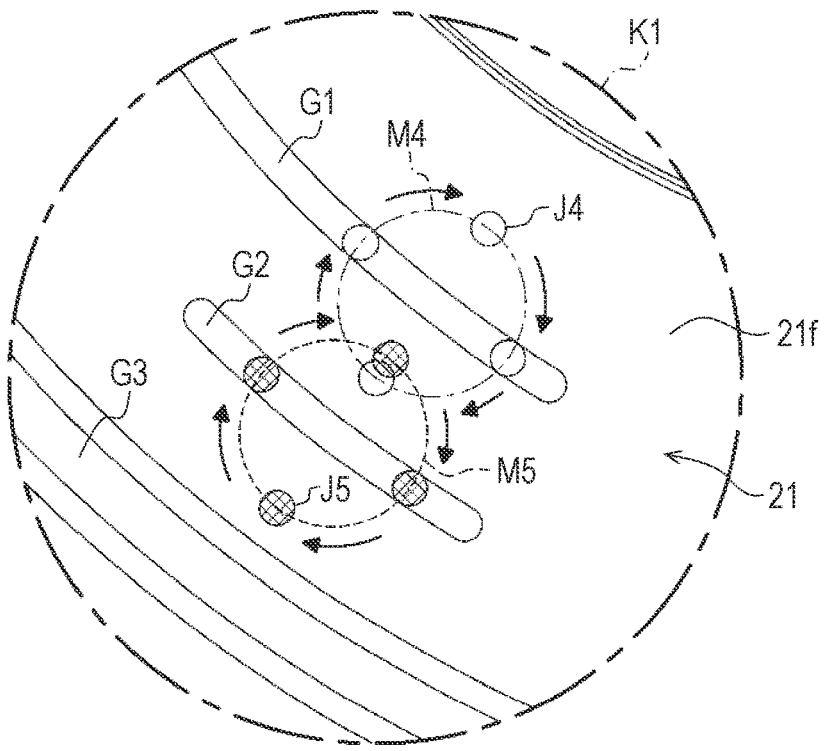
FIG. 5 is a view showing part of a region K1 of FIG. 4 in closeup for describing a movement locus of an opening of a first hole and a movement locus of an opening of a second hole in the scroll compressor according to the first embodiment.

FIG. 5 is the view showing part of a region K1 of FIG. 4 in closeup for describing a movement locus M4 of the opening J4 of the first hole and a movement locus M5 of the opening J5 of the second hole.

Note that in FIG. 5, the movement locus M4 of the opening J4 of the first hole H4 (see FIG. 2) provided at the upper surface of the revolving scroll 22 is indicated by a chain line. Moreover, the movement locus M5 of the opening J5 of the second hole H5 (see FIG. 2) is indicated by a dashed line.

As described above, the high-pressure lubricant oil from the oil supply path 3*d* (see FIG. 1) of the crankshaft 3 is intermittently supplied to the first groove G1 through the first hole H4 (see FIG. 2). The high-pressure lubricant oil from the oil supply path 3*d* (see FIG. 1) of the crankshaft 3 is intermittently supplied to the second groove G2 through the second hole H5 (see FIG. 2).

In an example of FIG. 5, the first hole H4 and the first groove G1 are connected to each other twice until the opening J4 of the first hole H4 (see FIG. 2) returns to an original position after having moved along the circular movement locus M4 as the revolving scroll 22 (see FIG. 2) revolves. Accordingly, a moderate amount of lubricant oil is supplied to the first groove G1 through the first hole H4. Similarly, the second hole H5 and the second groove G2 are connected to each other twice until the opening J5 of the second hole H5 (see FIG. 2) returns to an original position after having moved along the circular movement locus M5. Accordingly, a moderate amount of lubricant oil is supplied to the second groove G2 through the second hole H5.

Note that the high-pressure lubricant oil supplied to the first groove G1 and the second groove G2 does not remain in the first groove G1 and the second groove G2, but flows out through the tiny clearance between the end plate surface 21*f* of the fixed scroll 21 and the end plate 22*a* of the revolving scroll 22 (see FIG. 1). As described above, the lubricant oil is supplied twice per movement of each of the openings J4, J5. Since the distance between the second groove G2 and the back pressure groove G3 is relatively narrow, the lubricant oil is easily supplied to the back pressure chamber S4 (see FIG. 1) from the second groove G2 through the back pressure groove G3 even in normal operation. Thus, the Oldham's ring 7 and the like (see FIG. 1) provided in the back pressure chamber S4 can be sufficiently lubricated.

In the example of FIG. 5, the length of the arc-shaped second groove G2 in the circumferential direction is longer than the diameter of the circular movement locus M5 of the opening J5 of the second hole H5. Moreover, the arc-shaped second groove G2 and the circular movement locus M5 of the opening J5 of the second hole H5 cross each other at two locations. According to this configuration, the lubricant oil is supplied twice per movement of the opening J5. Thus, as compared to only one supply, a sufficient amount of lubricant oil can be supplied to the second groove G2 of the fixed scroll 21.

As described above, the second groove G2 overlaps with the first groove G1 in the radial direction. Thus, the first hole H4 intermittently connected to the first groove G1 and the second hole H5 intermittently connected to the second groove G2 can be formed next to each other in the radial direction (also see FIGS. 2 and 3). As a result, only one connection hole H2 (see FIG. 2) is needed for guiding the lubricant oil from the oil supply path 3*d* of the crankshaft 3 (see FIG. 1) to each of the first hole H4 (see FIG. 2) and the second hole H5 (see FIG. 2). Thus, time and effort in the process of forming the connection hole H2 at the revolving scroll 22 by, e.g., cutting can be reduced.

Since the second groove G2 overlaps with the first groove G1 in the radial direction, the high-pressure lubricant oil in one of the first groove G1 or the second groove G2 acts as a wall on the high-pressure lubricant oil in the other one of the first groove G1 or the second groove G2. As a result, the high-pressure lubricant oil in the first groove G1 is more easily supplied to the compression chamber S1 (see FIG. 1) than to the back pressure groove G3. On the other hand, the high-pressure lubricant oil in the second groove G2 is more easily supplied to the back pressure groove G3 than to the compression chamber S1 (see FIG. 1).

Note that in the example shown in FIG. 4, the second groove G2 is provided in the vicinity of one end (an end portion on a suction port J1 side) of the first groove G1 in the circumferential direction. On this point, the position of the second groove G2 is not limited to above. For example, the second groove G2 may be provided in the vicinity of the opposite end portion of the first groove G1 in the circumferential direction, or may be provided in the vicinity of the center of the first groove G1 in the circumferential direction. This is because in either case, the high-pressure lubricant oil is supplied from the second groove G2 to the back pressure groove G3 when the revolving scroll 22 swings and tilts.

<Advantageous Effects>

According to the first embodiment, the high-pressure lubricant oil is supplied to the arc-shaped first groove G1 (see FIG. 4) provided at the end plate surface 21*f* of the fixed scroll 21. This can reduce strong contact of the end plate 22*a* of the revolving scroll 22 with the fixed scroll 21 in the vicinity of the first groove G1.

The distance L2*a* (see FIG. 4) between the second groove G2 and the back pressure groove G3 is shorter than the distance L1*a* (see FIG. 4) between the first groove G1 and the back pressure groove G3. Thus, even when the revolving scroll 22 swings and tilts, the high-pressure lubricant oil is supplied from the second groove G2 to the back pressure chamber S4 (see FIG. 1) through the back pressure groove G3. As a result, the pressure of the back pressure chamber S4 temporarily increases. Thus, swing of the revolving scroll 22 is promptly reduced so that an operation state can return to a proper state. That is, degradation of the efficiency due to rollover of the revolving scroll 22 can be reduced. Thus, across a wide range of operation condition, the reliability of the scroll compressor 100 can be ensured, and also the performance (efficiency) of the scroll compressor 100 can be improved.

The first groove G1 and the second groove G2 at least partially overlap with each other in the radial direction. Thus, the connection hole H2 (see FIG. 2) connected to both of the first hole H4 and the second hole H5 can be provided. That is, only one connection hole H2 (see FIG. 2) for guiding the high-pressure lubricant oil from the oil supply path 3*d* of the crankshaft 3 to the first hole H4 and the second hole H5 is needed. Thus, the time and effort in the process of forming the connection hole H2 by, e.g., cutting can be reduced. As a result, the cost for manufacturing the scroll compressor 100 can be reduced.

Second Embodiment

Figure 6:
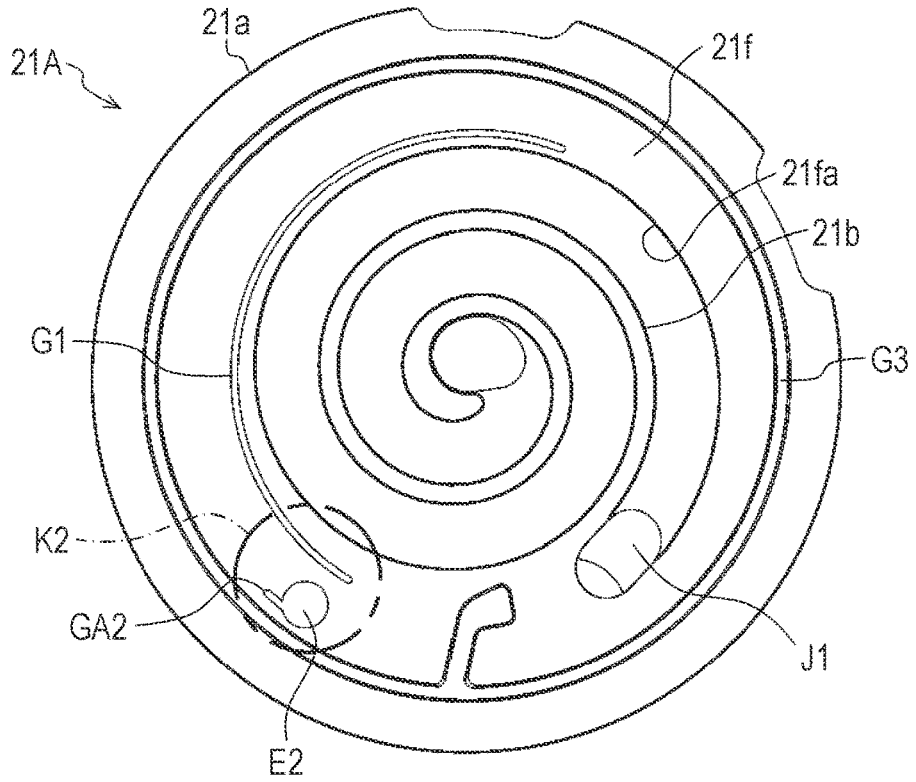
FIG. 6 is a bottom view of a fixed scroll included in a scroll compressor according to a second embodiment.

A difference of a second embodiment from the first embodiment is that a recessed portion E2 (see FIG. 6) constantly connected to an opening J5 (see FIG. 2) of a second hole H5 (see FIG. 2) is provided at an end plate surface 21*f* of a fixed scroll 21A (see FIG. 6). Note that other configurations (e.g., an entire configuration of a scroll compressor 100: see FIG. 1) in the second embodiment are similar to those of the first embodiment. Thus, the difference of the second embodiment from the first embodiment will be described, and description of overlapping contents will be omitted.

FIG. 6 is a bottom view of the fixed scroll 21A included in the scroll compressor according to the second embodiment.

As shown in FIG. 6, the recessed portion E2 connected to a second groove GA2 is provided outside a first groove G1 in a radial direction at the end plate surface 21*f* of the fixed scroll 21A. The length of the second groove GA2 in a circumferential direction is shorter than that in the case of the first embodiment (see FIG. 4). Note that the length of the entire region of the second groove GA2 and the recessed portion E2 in the circumferential direction is similar to the length of the second groove G2 in the circumferential direction in the first embodiment.

In an example of FIG. 6, the recessed portion E2 is provided on one end side (an end side closer to a suction port J1) of the arc-shaped second groove GA2. The recessed portion E2 is a portion constantly connected to the second hole H5 (see FIG. 2) at a revolving scroll 22 (see FIG. 2). The recessed portion E2 is recessed upwardly from the end plate surface 21*f*, and is in a circular shape as viewed from below.

Note that the position of the recessed portion E2 in the circumferential direction is not limited to that in the example of FIG. 6. As described next, as long as a circular movement locus M5 (see FIG. 7) of the opening J5 of the second hole H5 (see FIG. 2) is included in a region S6 (see FIG. 7) of the recessed portion E2, the recessed portion E2 may be provided on the other end side of the second groove GA2, or may be provided in the vicinity of the center of the second groove GA2 in the circumferential direction. In addition to the second groove GA2, the circular recessed portion E2 also overlaps with the first groove G1 in the radial direction. A reason why such arrangement is employed will be described using FIG. 7.

Figure 7:
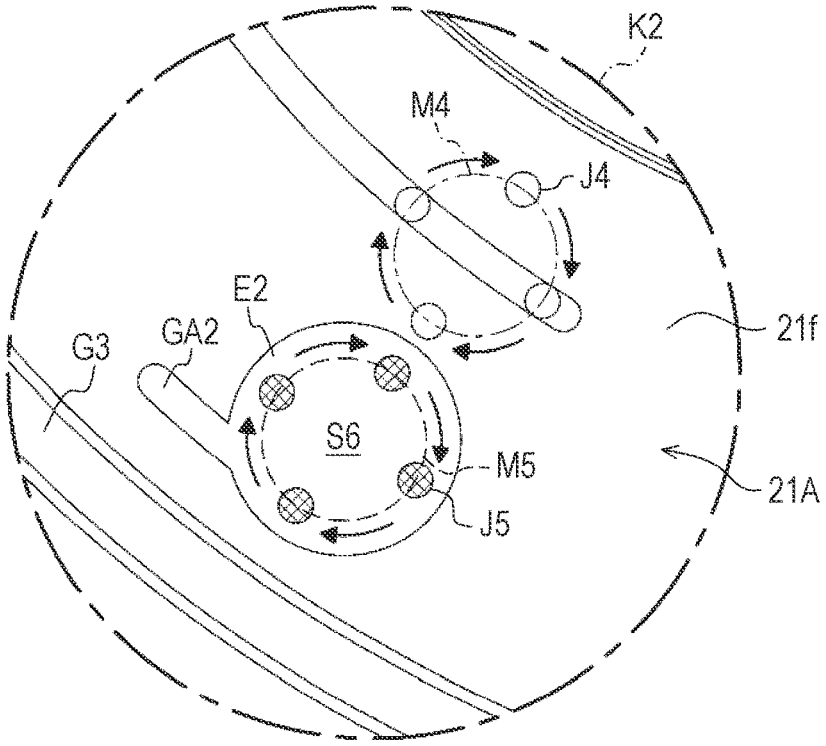
FIG. 7 is a view showing part of a region K2 of FIG. 6 in closeup for describing a movement locus of an opening of a first hole and a movement locus of an opening of a second hole in the scroll compressor according to the second embodiment.

FIG. 7 is a view showing part of a region K2 of FIG. 6 in closeup for describing a movement locus M4 of an opening J4 of a first hole and the movement locus M5 of the opening J5 of the second hole.

As shown in FIG. 7, at the end plate surface 21*f* of the fixed scroll 21A, the movement locus M5 of the opening J5 of the second hole H5 (see FIG. 2) is included in the region S6 of the recessed portion E2. Note that in an example of FIG. 7, the movement locus M4 of the opening J4 of the first hole H4 (see FIG. 2) partially overlaps with the first groove G1, but is not included in the region S6 of the recessed portion E2.

According to this configuration, when the revolving scroll 22 (see FIG. 2) moves (revolves), the second hole H5 (see FIG. 2) is constantly connected to the recessed portion E2 and the second groove GA2. Thus, the amount of high-pressure lubricant oil to be supplied to the recessed portion E2 and the second groove GA2 per unit time can be increased as compared to the first embodiment.

<Advantageous Effects>

According to the second embodiment, the second hole H5 is constantly connected to the recessed portion E2 and the second groove GA2 during drive of the scroll compressor. Thus, the amount of high-pressure lubricant oil flowing into a back pressure chamber S4 (see FIG. 1) through a back pressure groove G3 (see FIG. 6) when the revolving scroll 22 (see FIG. 1) swings and tilts can be increased as compared to the first embodiment. As a result, the revolving scroll 22 (see FIG. 1) can be promptly returned to a proper state.

Third Embodiment

A difference of a third embodiment from the second embodiment is that a recessed portion E3 (see FIG. 9) provided at an end plate surface 21*f* of a fixed scroll 21B (see FIG. 8) is intermittently connected to an opening J5 (see FIG. 9) of a second hole H5 (see FIG. 2) and is also intermittently connected to an opening J4 (see FIG. 9) of a first hole H4 (see FIG. 2). Note that other configurations in the third embodiment are similar to those of the second embodiment. Thus, the difference of the third embodiment from the second embodiment will be described, and description of overlapping contents will be omitted.

Figure 8:
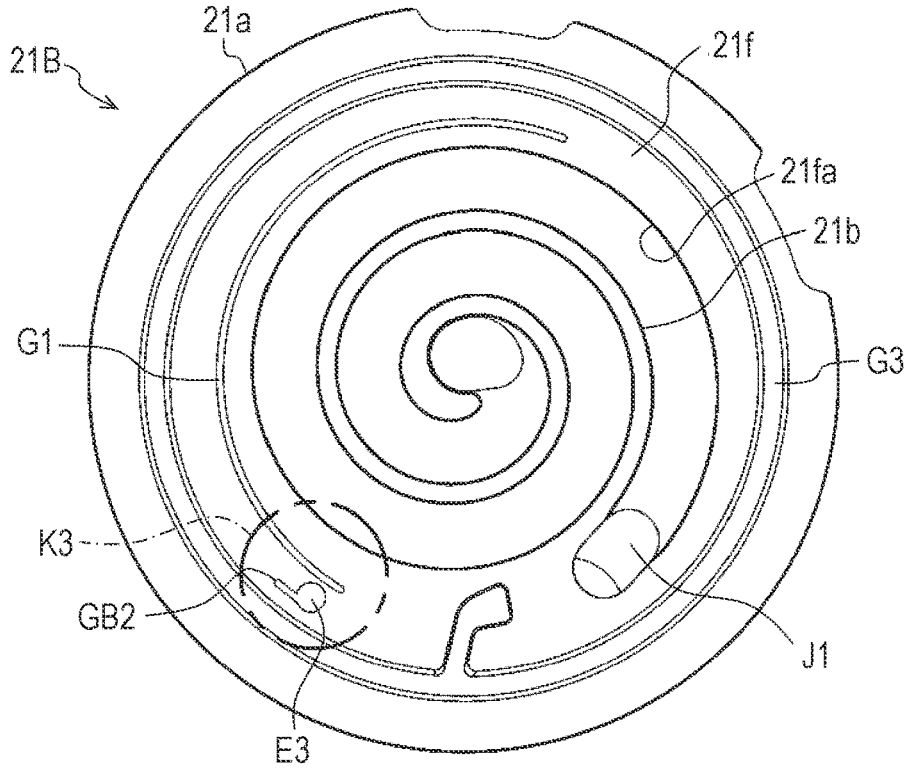
FIG. 8 is a bottom view of a fixed scroll included in a scroll compressor according to a third embodiment.

FIG. 8 is a bottom view of the fixed scroll 21B included in a scroll compressor according to the third embodiment.

As shown in FIG. 8, the recessed portion E3 connected to a second groove GB2 is provided outside a fixed wrap 21*b* in a radial direction at the end plate surface 21*f* of the fixed scroll 21B. Note that a distance between the recessed portion E3 and a first groove G1 is shorter than that in the case of the second embodiment (see FIG. 6). Moreover, the diameter of the circular recessed portion E3 is shorter than that in the case of the second embodiment (see FIG. 6). Further, in addition to the second groove GB2, the circular recessed portion E3 also overlaps with the first groove G1 in the radial direction.

Figure 9:
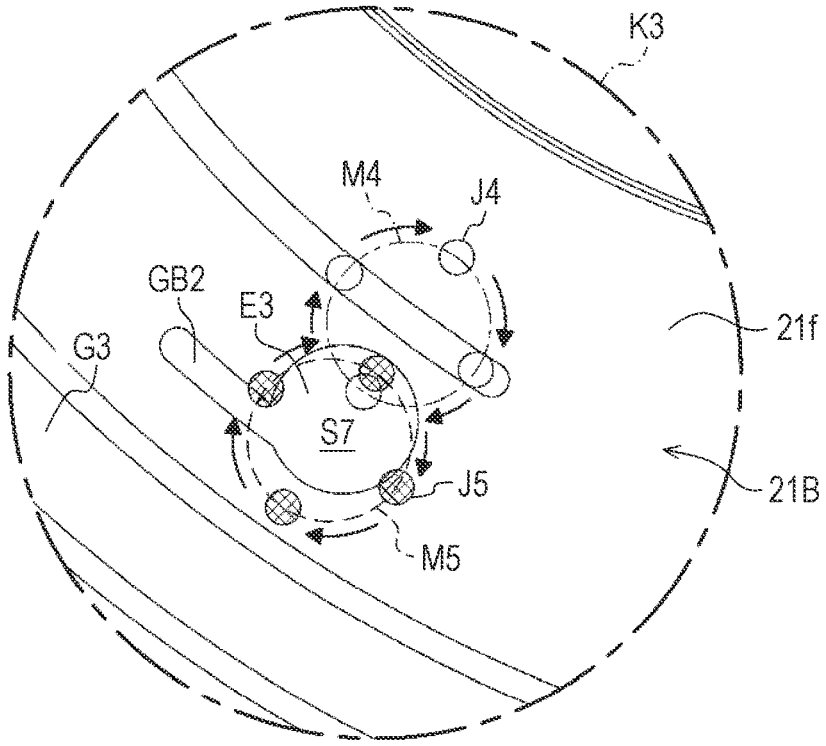
FIG. 9 is a view showing part of a region K3 of FIG. 8 in closeup for describing a movement locus of an opening of a first hole and a movement locus of an opening of a second hole in the scroll compressor according to the third embodiment.

FIG. 9 is a view showing part of a region K3 of FIG. 8 in closeup for describing a movement locus M4 of the opening J4 of the first hole and a movement locus M5 of the opening J5 of the second hole.

As shown in FIG. 9, at the end plate surface 21*f* of the fixed scroll 21B, part of the movement locus M5 of the opening J5 of the second hole H5 (see FIG. 2) is included in a region S7 of the recessed portion E3. On the other hand, the remaining movement locus M5 of the opening J5 of the second hole H5 (see FIG. 2) deviates from the region S7 of the recessed portion E3. In a case where due to spatial limitations, it is difficult to employ the constant connection configuration (the configuration in which the opening J5 is constantly connected to the recessed portion E2: see FIG. 7) as in the second embodiment, the configuration as shown in FIG. 9 can be employed.

At the end plate surface 21*f* of the fixed scroll 21B, part of the movement locus M4 of the opening J4 of the first hole H4 (see FIG. 2) is also included in the region S7 of the recessed portion E3. According to this configuration, high-pressure lubricant oil is intermittently supplied to the recessed portion E3 through the second hole H5 (see FIG. 2). Further, high-pressure lubricant oil is intermittently supplied to the recessed portion E3 through the first hole H4 (see FIG. 2). Thus, even in the configuration in which the movement locus M5 of the opening J5 of the second hole H5 (see FIG. 2) partially deviates from the region S7 of the recessed portion E3, a sufficient amount of high-pressure lubricant oil to be supplied to the recessed portion E3 and the second groove GB2 per unit time can be ensured.

<Advantageous Effects>

According to the third embodiment, during drive of the scroll compressor, the second hole H5 (see FIG. 2) is intermittently connected to the recessed portion E3 (see FIG. 9), and the first hole H4 (see FIG. 2) is also intermittently connected to the recessed portion E3. Thus, the amount of high-pressure lubricant oil flowing into a back pressure chamber S4 (see FIG. 1) through a back pressure groove G3 (see FIG. 8) when a revolving scroll 22 (see FIG. 1) swings and tilts can be increased as compared to the first embodiment. As a result, the revolving scroll 22 (see FIG. 1) can be promptly returned to a proper state.

Fourth Embodiment

In a fourth embodiment, an air-conditioner W1 (a refrigeration cycle device: see FIG. 10) including a scroll compressor 100 (see FIG. 1) described in the first embodiment will be described.

Figure 10:
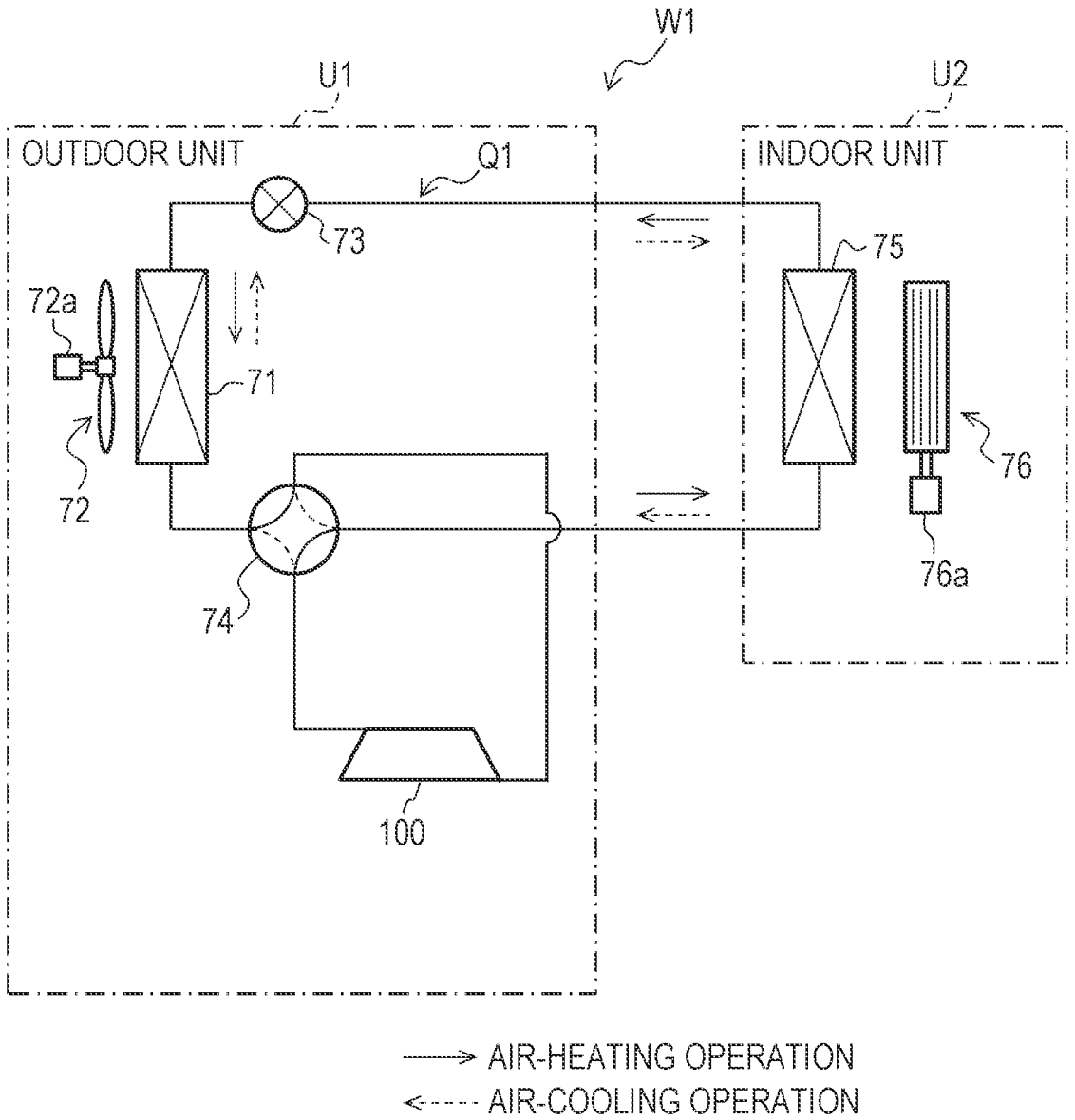
FIG. 10 is a configuration diagram including a refrigerant circuit of an air-conditioner according to a fourth embodiment.

FIG. 10 is a configuration diagram including a refrigerant circuit Q1 of the air-conditioner W1 according to the fourth embodiment.

Note that solid arrows in FIG. 10 indicate the flow of refrigerant in air-heating operation.

On the other hand, dashed arrows in FIG. 10 indicate the flow of refrigerant in air-cooling operation.

The air-conditioner W1 is equipment configured to perform air-conditioning such as air-cooling or air-heating. As shown in FIG. 10, the air-conditioner W1 includes the scroll compressor 100, an outdoor heat exchanger 71, an outdoor fan 72, an expansion valve 73, a four-way valve 74, an indoor heat exchanger 75, and an indoor fan 76.

In an example of FIG. 10, the scroll compressor 100, the outdoor heat exchanger 71, the outdoor fan 72, the expansion valve 73, and the four-way valve 74 are provided in an outdoor unit U1. On the other hand, the indoor heat exchanger 75 and the indoor fan 76 are provided in an indoor unit U2.

The scroll compressor 100 is equipment configured to compress gaseous refrigerant. The scroll compressor 100 includes, for example, a configuration similar to that of the first embodiment (see FIG. 1).

The outdoor heat exchanger 71 is a heat exchanger configured to exchange heat between refrigerant flowing in a heat transfer pipe (not shown) of the heat exchanger and external air sent from the outdoor fan 72.

The outdoor fan 72 is a fan configured to send external air into the outdoor heat exchanger 71. The outdoor fan 72 includes an outdoor fan motor 72*a* as a drive source, and is placed in the vicinity of the outdoor heat exchanger 71.

The indoor heat exchanger 75 is a heat exchanger configured to exchange heat between refrigerant flowing in a heat transfer pipe (not shown) of the heat exchanger and indoor air (air in an air-conditioning room) sent from the indoor fan 76.

The indoor fan 76 is a fan configured to send indoor air into the indoor heat exchanger 75. The indoor fan 76 includes an indoor fan motor 76*a* as a drive source, and is placed in the vicinity of the indoor heat exchanger 75.

The expansion valve 73 is a valve configured to depressurize refrigerant condensed in a "condenser" (one of the outdoor heat exchanger 71 or the indoor heat exchanger 75). Note that the refrigerant depressurized by the expansion valve 73 is guided to an "evaporator" (the other one of the outdoor heat exchanger 71 or the indoor heat exchanger 75).

The four-way valve 74 is a valve configured to switch a refrigerant flow path according to an operation mode of the air-conditioner W1. For example, in the air-cooling operation (see the dashed arrows in FIG. 10), in the refrigerant circuit Q1, refrigerant circulates sequentially through the scroll compressor 100, the outdoor heat exchanger 71 (the condenser), the expansion valve 73, and the indoor heat exchanger 75 (the evaporator). On the other hand, in the air-heating operation (see the solid arrows in FIG. 10), in the refrigerant circuit Q1, refrigerant circulates sequentially through the scroll compressor 100, the indoor heat exchanger 75 (the condenser), the expansion valve 73, and the outdoor heat exchanger 71 (the evaporator).

<Advantageous Effects>

According to the fourth embodiment, the air-conditioner W1 includes the scroll compressor 100 manufactured at low cost and having high efficiency and reliability. Thus, the cost for manufacturing the entirety of the air-conditioner W1 can be reduced, and the performance and reliability of the air-conditioner W1 can be enhanced.

<<Variations>>

The scroll compressor 100 and the air-conditioner W1 according to one aspect of the present disclosure have been described above with reference to each embodiment. The aspect of the present disclosure is not limited to these embodiments. These embodiments may be changed as necessary.

For example, in the configuration described in each embodiment, the substantially entirety of the second groove G2 (see FIG. 4) overlaps with the first groove G1 (see FIG. 4) in the radial direction. On this point, the first groove G1 and the second groove G2 may at least partially overlap with each other in the radial direction.

In the configuration described in each embodiment, part of the movement locus M4 (see FIG. 5) of the opening J4 of the first hole H4 (see FIG. 2) is included in the first groove G1. On this point, the entirety of the movement locus M4 (see FIG. 5) of the opening J4 of the first hole H4 (see FIG. 2) may be included in the first groove G1. In this case, a circular recessed portion (not shown) connected to the first hole H4 may be provided, and the entirety of the movement locus M4 of the opening J4 of the first hole H4 (see FIG. 2) may be included in the recessed portion. That is, at least part of the movement locus M4 of the opening J4 of the first hole H4 may be included in the first groove G1. Similarly, at least part of the movement locus M5 of the opening J5 of the second hole H5 (see FIG. 2) may be included in the second groove G2.

In the configuration described in each embodiment, the number of second grooves G2 (see FIG. 4) is one. On this point, multiple second grooves G2 having a substantially equal distance to the back pressure groove G3 in the radial direction may be provided, for example. In this case, multiple second holes H5 may be provided corresponding to the multiple second grooves G2. Alternatively, one second hole H5 may be alternately connected to the multiple second grooves G2.

In the configuration described in the third embodiment, part of the movement locus M5 (see FIG. 9) of the opening J5 of the second hole H5 (see FIG. 2) is included in the recessed portion E3 (see FIG. 9). Further, part of the movement locus M4 (see FIG. 9) of the opening J4 of the first hole H4 (see FIG. 2) is included in the recessed portion E3. On this point, the following configuration may be employed without the recessed portion E3, for example. That is, at least part of the movement locus M5 of the opening J5 of the second hole H5 may be included in the second groove G2, and at least part of the movement locus M4 of the opening J4 of the first hole H4 may be also included in the second groove G2. With this configuration, a sufficient amount of lubricant oil can be also supplied to the second groove G2.

As described in the first embodiment, at least part of the movement locus M4 (see FIG. 5) of the opening J4 of the first hole H4 (see FIG. 2) may be included in the first groove G1 (see FIG. 5), and the movement locus M5 (see FIG. 5) of the opening J5 of the second hole H5 (see FIG. 2) is not necessarily included in the first groove G1. With this configuration, when the revolving scroll 22 swings and tilts, the high-pressure lubricant oil is also supplied to the back pressure chamber S4 (see FIG. 1) from the second groove G2 through the back pressure groove G3. Accordingly, swing of the revolving scroll 22 (see FIG. 1) can be reduced.

The embodiments may be combined as necessary. For example, the second embodiment and the fourth embodiment may be combined with each other. In this case, the air-conditioner may be configured as follows. The air-conditioner includes the scroll compressor configured such that the recessed portion E2 (see FIG. 7) constantly connected to the opening J5 of the second hole H5 (see FIG. 2) is provided (the second embodiment). Further, the air-conditioner includes the outdoor heat exchanger 71 (see FIG. 10), the expansion valve 73, the indoor heat exchanger 75, and the like (the fourth embodiment). Note that the third embodiment and the fourth embodiment may be combined with each other.

The air-conditioner W1 (see FIG. 10) described in the fourth embodiment is applicable to various types of air-conditioners such as a room air-conditioner, a packaged air-conditioner, and a building multi-type air-conditioner. The fourth embodiment has further described the air-conditioner W1 (the refrigeration cycle device) including the scroll compressor 100. Note that the fourth embodiment is not limited to the air-conditioner and is also applicable to other "refrigeration cycle devices" such as a freezer, a water heater, an air-conditioning water heating device, a chiller, and a refrigerator.

Each embodiment has described the case where refrigerant is compressed by the scroll compressor 100. On this point, each embodiment is also applicable to a case where predetermined gas other than refrigerant is compressed by the scroll compressor 100.

Each embodiment has been described in detail for the sake of simplicity in description of the technique of the present disclosure. The technique of the present disclosure is not limited to one including all configurations described in each embodiment. Some of the configurations of each embodiment may be omitted or replaced with other configurations as necessary. Other configurations may be added to the configurations of the embodiments and the like as necessary.

Each embodiment above has described the mechanisms and configurations assumed as necessary for description.

Each embodiment does not necessarily describe all mechanisms and configurations necessary for a product.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A scroll compressor comprising:

a hermetic container;

an electric motor having a stator and a rotor and housed in the hermetic container;

a shaft having an oil supply path in which lubricant oil flows and rotating integrally with the rotor;

a fixed scroll having a spiral fixed wrap;

a revolving scroll having a spiral revolving wrap and provided such that a compression chamber is formed between the fixed wrap and the revolving wrap; and a frame having an insertion hole for the shaft and supporting the fixed scroll, wherein a back pressure chamber is provided between the revolving scroll and the frame, at an end plate surface of the fixed scroll, an annular back pressure groove connected to the back pressure chamber is provided, and an arc-shaped first groove and an arc-shaped second groove are provided inside the back pressure groove in a radial direction, a distance between the second groove and the back pressure groove is shorter than a distance between the first groove and the back pressure groove, the revolving scroll is provided with a first hole and a second hole for guiding the lubricant oil from the oil supply path to an end plate surface side of the fixed scroll, at least part of a movement locus of an opening of the first hole is included in the first groove, at least part of a movement locus of an opening of the second hole is included in the second groove, and the first groove and the second groove at least partially overlap with each other in the radial direction.

2. The scroll compressor according to claim 1, wherein a length of the arc-shaped second groove in a circumferential direction is shorter than a length of the arc-shaped first groove in the circumferential direction.

3. The scroll compressor according to claim 1, wherein a length of the arc-shaped second groove in the circumferential direction is longer than a diameter of the circular movement locus of the opening of the second hole, and the arc-shaped second groove and the circular movement locus of the opening of the second hole cross each other at two locations.

4. The scroll compressor according to claim 1, wherein a center angle of the arc-shaped second groove is equal to or greater than 10° and equal to or less than 30°.

5. The scroll compressor according to claim 1, wherein a recessed portion connected to the second groove is provided at the end plate surface of the fixed scroll, and the movement locus of the opening of the second hole is included in a region of the recessed portion.

6. The scroll compressor according to claim 1, wherein a recessed portion connected to the second groove is provided at the end plate surface of the fixed scroll, and not only part of the movement locus of the opening of the second hole but also part of the movement locus of the opening of the first hole are included in a region of the recessed portion.

7. The scroll compressor according to claim 1, wherein not only at least part of the movement locus of the opening of the second hole but also at least part of the movement locus of the opening of the first hole are included in the second groove.

8. The scroll compressor according to claim 1, wherein at least part of the movement locus of the opening of the first hole is included in the first groove, but the movement locus of the opening of the second hole is not included in the first groove.

9. A refrigeration cycle device comprising:

the scroll compressor according to claim 1;

an outdoor heat exchanger;

an expansion valve; and an indoor heat exchanger.

10. A scroll compressor comprising:

a hermetic container;

an electric motor having a stator and a rotor and housed in the hermetic container;

a shaft having an oil supply path in which lubricant oil flows and rotating integrally with the rotor;

a fixed scroll having a spiral fixed wrap;

a revolving scroll having a spiral revolving wrap and provided such that a compression chamber is formed between the fixed wrap and the revolving wrap; and a frame having an insertion hole for the shaft and supporting the fixed scroll, wherein a back pressure chamber is provided between the revolving scroll and the frame, at an end plate surface of the fixed scroll, an annular back pressure groove connected to the back pressure chamber is provided, and an arc-shaped first groove and an arc-shaped second groove are provided inside the back pressure groove in a radial direction, a distance between the second groove and the back pressure groove is shorter than a distance between the first groove and the back pressure groove, the revolving scroll is provided with a first hole and a second hole for guiding the lubricant oil from the oil supply path to an end plate surface side of the fixed scroll, at least part of a movement locus of an opening of the first hole is included in the first groove, at least part of a movement locus of an opening of the second hole is included in the second groove, and a connection hole connected to the oil supply path and connected to both of the first hole and the second hole is provided at the revolving scroll.

11. The scroll compressor according to claim 10, wherein a length of the arc-shaped second groove in a circumferential direction is shorter than a length of the arc-shaped first groove in the circumferential direction.

12. The scroll compressor according to claim 10, wherein a length of the arc-shaped second groove in the circumferential direction is longer than a diameter of the circular movement locus of the opening of the second hole, and the arc-shaped second groove and the circular movement locus of the opening of the second hole cross each other at two locations.

13. The scroll compressor according to claim 10, wherein a center angle of the arc-shaped second groove is equal to or greater than 10° and equal to or less than 30°.

14. The scroll compressor according to claim 10, wherein a recessed portion connected to the second groove is provided at the end plate surface of the fixed scroll, and the movement locus of the opening of the second hole is included in a region of the recessed portion.

15. The scroll compressor according to claim 10, wherein a recessed portion connected to the second groove is provided at the end plate surface of the fixed scroll, and not only part of the movement locus of the opening of the second hole but also part of the movement locus of the opening of the first hole are included in a region of the recessed portion.

16. The scroll compressor according to claim 10, wherein not only at least part of the movement locus of the opening of the second hole but also at least part of the movement locus of the opening of the first hole are included in the second groove.

17. The scroll compressor according to claim 10, wherein at least part of the movement locus of the opening of the first hole is included in the first groove, but the movement locus of the opening of the second hole is not included in the first groove.

18. A refrigeration cycle device comprising:
the scroll compressor according to claim 10;
an outdoor heat exchanger;
an expansion valve; and
an indoor heat exchanger.

* * * * *